US009576585B2

(12) United States Patent
Bleidt

(10) Patent No.: US 9,576,585 B2
(45) Date of Patent: Feb. 21, 2017

(54) METHOD AND APPARATUS FOR NORMALIZED AUDIO PLAYBACK OF MEDIA WITH AND WITHOUT EMBEDDED LOUDNESS METADATA OF NEW MEDIA DEVICES

(71) Applicant: Fraunhofer-Gesellschaft zur Foerderung der angewandten Forschung e.V., Munich (DE)

(72) Inventor: Robert Bleidt, Plymouth, MI (US)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/811,203

(22) Filed: Jul. 28, 2015

(65) Prior Publication Data

US 2015/0332685 A1 Nov. 19, 2015

Related U.S. Application Data

(63) Continuation of application No. PCT/EP2014/051484, filed on Jan. 27, 2014.

(Continued)

(51) Int. Cl.

*G10L 19/00* (2013.01)
*G10L 19/012* (2013.01)
*G10L 19/26* (2013.01)

(52) U.S. Cl.

CPC ..... *G10L 19/012* (2013.01); *G10L 19/26* (2013.01)

(58) Field of Classification Search

CPC ..... G10L 19/00; G10L 19/0017; G10L 19/02; G10L 19/008; G10L 19/035; G10L 19/22; G10L 19/24; G10L 2019/00; G10L 2019/0003

(Continued)

(56) References Cited

U.S. PATENT DOCUMENTS 7,617,109 B2 11/2009 Smithers et al.
8,032,385 B2 10/2011 Smithers et al.

(Continued)

FOREIGN PATENT DOCUMENTS

RU 2406165 C2 12/2010
RU 2406166 C2 12/2010

(Continued)

OTHER PUBLICATIONS

"Advanced Television Systems Committee, Inc.", Audio Compression Standard A/52, www.atsc.org.

(Continued)

*Primary Examiner* — Qi Han
(74) *Attorney, Agent, or Firm* — Perkins Coie LLP; Michael A. Glenn

(57) ABSTRACT

A decoder device for decoding a bitstream so as to produce therefrom an audio output signal, the bitstream having audio data and optionally loudness metadata containing a reference loudness value, wherein a gain control device has a reference loudness decoder configured to create a loudness value, wherein the loudness value is the reference loudness value in case that the reference loudness value is present in the bitstream; wherein the gain control device has a gain calculator configured to calculate a gain value based on the loudness value and based on a volume control value, which is provided by an external user interface allowing a user to control the volume control value, and a loudness processor configured to control the loudness of the audio output signal based on the gain value.

16 Claims, 5 Drawing Sheets

Related U.S. Application Data

(60) Provisional application No. 61/757,606, filed on Jan. 28, 2013.

(58) Field of Classification Search
USPC ..... 704/500, 501, 503, 504, 225
See application file for complete search history.

(56) References Cited

U.S. PATENT DOCUMENTS

| | | | | |
|---|---|---|---|---|
| 2004/0199933 | A1* | 10/2004 | Ficco | H04N 5/602 725/151 |
| 2006/0002572 | A1 | 1/2006 | Smithers et al. | |
| 2009/0067634 | A1* | 3/2009 | Oh | H04S 3/008 381/17 |
| 2009/0287496 | A1* | 11/2009 | Thyssen | H03G 7/007 704/500 |
| 2012/0328115 | A1* | 12/2012 | Wolters | H03G 9/00 381/57 |
| 2013/0094668 | A1* | 4/2013 | Poulsen | H03G 3/301 381/107 |

FOREIGN PATENT DOCUMENTS

| | | | |
|---|---|---|---|
| WO | 2006113062 | A1 | 10/2006 |
| WO | 2012146757 | A1 | 11/2012 |
| WO | 2014113471 | A1 | 7/2014 |

OTHER PUBLICATIONS

"Dolby Laboratories, Inc., Dolby Digital Professional Encoding Guidelines, www.dolby.com", Dolby Laboratories, Inc., Dolby Digital Professional Encoding Guidelines, www.dolby.com.

"Part 1—Specification for the use of Video and Audio Coding in Broadcasting Applications based on the MPEG-2 transport stream", European Telecommunications Standards Institute, ETSI TS 101 154: Digital Video Broadcasting (DVB); www.etsi.org.

"Part 2—Specification for the use of Video and Audio Coding in Broadcasting Applications based on the MPEG-2 transport stream", European Telecommunications Standards Institute, ETSI TS 101 154: Digital Video Broadcasting (DVB); www.etsi.org.

Camerer, Florian, "Loudness Normalization: The Future of File-Based Playback", Music Loudness Alliance, www.music-loudness.com.

Hamalainen, Perttu, "Smoothing of the Control Signal Without Clipped Output in Digital Peak Limiters", Proc. of the 5th International Conference on Digital Audio Effects, Hamburg, Germany, Sep. 26-28, 2002.

International Telecommunications, "Algorithms to measure audio programme loudness and true-peak audio level", International Telecommunications Union, Recommendation ITU-R BS.1770-3. www.itu.int.

Wolters, Martin et al., "Loudness Normalization in the Age of Portable Media Players", paper 8044, Audio Engineering Society 128th Convention, www.aes.org.

International Organization for Standardization and International Electrotechnical Commission, ISO/IEC 14496-3 Information technology—Coding of audio-visual objects—Part 3: Audio, www.iso.org.

"A Guide to Dolby Metadata", Jan. 1, 2005, pp. 1-28, XP055102178, retrieved from the Internet: URL: http://www.dolby.com/uploadedFiles/Assets/US/Doc/Professional/18_Metadata.Guide.pdf [retrieved on Feb. 14, 2014], page abstract, p. 5, paragraph [2 Dialogue Level], p. 8.

"Digital Video Broadcasting (DVB); Specification for the use of Video and Audio Coding in Broadcasting Applications based on the MPEG-2 Transport Stream", ETSI Draft; 00V1111, European Telecommunications Standards Institute (ETSI), 650, Route des Lucioles; F-06921 Sophia-Antipolis; France, No. V1.11.1, Jul. 24, 2012, pp. 1-194, XP014071122, [retrieved on Jul. 24, 2012].

Wolters, Martin et al., "Loudness Normalization in the Age of Portable Media Players", AES Convention 128; May 2010, AES, 60 East 42nd Street, Room 2520 New York 10165-2520, USA, May 1, 2010, XP040509427, abstract p. 6, paragraph [3.2 Conveying loundness values]—p. 7, paragraph [3.2.1 Matching Replay Gain syntax].

* cited by examiner

METHOD AND APPARATUS FOR NORMALIZED AUDIO PLAYBACK OF MEDIA WITH AND WITHOUT EMBEDDED LOUDNESS METADATA OF NEW MEDIA DEVICES

CROSS-REFERENCE TO RELATED APPLICATIONS

This application is a continuation of copending International Application No. PCT/EP2014/051484, filed Jan. 27, 2014, which is incorporated herein by reference in its entirety, and additionally claims priority from U.S. Provisional Application No. 61/757,606, filed Jan. 28, 2013, which is also incorporated herein by reference in its entirety.

BACKGROUND OF THE INVENTION

The invention relates to the control of the loudness of audio, video, and multimedia content played back in digital form on electronic reproduction devices, specifically but not exclusively to the control of the playback loudness with content that is prepared both with and without embedded loudness metadata as commonly occurs in new media devices.

In the production and transmission of music, video, and other multimedia content, the process of loudness normalization is carried out to ensure that the consumer hears the audio signal with an appropriate loudness from song to song or program to program.

Since the early days of recording and films, this has been done during the production process or through reproduction standards for theaters. The common practice today in the music and radio broadcasting industries is to adjust the loudness to a value near the maximum peak level of the medium, while the practice in the film or television industries is to use one of several standard loudness levels that may be 20 to 31 dB below the maximum peak level. In the era before media convergence, this was unnoticed by consumers as separate devices or volume settings were used to playback each type of content.

With the advent of mobile devices such as mobile phones or portable media players that are intended to playback both music and film content, this difference in production practices leads to loudness differences that may be as much as 30 dB, if the content is transmitted to the device without modification. This can lead to movies that are too quiet, or music that is too loud, when switching from one type of content to another.

A related trend is the increase in loudness of many genres of recorded music through the use of strong dynamic range compression, limiting, and clipping during the mastering of a recording. Such mastering is done considering only lossless recording media such as Compact Discs, though the majority of music sold today is in lossy data-compressed formats such as MPEG AAC and MP3. The data compression process may introduce changes in the time-domain waveform reconstructed in the decoder during playback that cause overshoots in the waveform above the full-scale limits or maximum peak value of the signal. In a fixed-point decoder (or saturating floating-point decoder) typically used in mobile devices, this can lead to clipping of the overshoot to the full-scale limit, causing additional audible clipping in the reproduced signal.

This strong compression and clipping of music is done in some cases for artistic purposes, but is more commonly done either as an attempt to increase the commercial appeal of a recording by making it "sound louder" than others, or to provide content that can be understood in all listening circumstances, such as in airports or noisy places as well as quiet environments.

In the film and video industries, wide audio dynamic range is used in some genres for dramatic effect and to create a more engaging experience. When conveyed to a consumer through the Dolby Digital or MPEG-4 AAC codecs, audio dynamic range control metadata is often included to allow the dynamic range to be optionally reduced at the receiver or player for cases where there is a noisy environment or where loud scenes would be too disturbing.

The traditional metadata included in DVD or BluRay content encoded with Dolby Digital or transmitted in TV signals encoded with Dolby Digital (standardized in Advanced Television Systems Committee, Inc. Audio Compression Standard A/52) or MPEG-4 AAC (standardized in ISO/IEC 14496-3 and ETSI TS 101 154) includes the following components:

1. A single, static metadata value indicating the overall long-term integrated loudness of the program, termed program reference level in the MPEG standards.

2. Static metadata values for downmix gains used to control the down-mixing of multi-channel content for output through a stereo or monophonic device.

3. Two sets of dynamic range control gains or scaling factors, sent for each data-compressed bitstream frame for a plurality of frequency bands or regions in the audio signal. One is used for "light" compression in the industry vernacular and the other for "heavy" compression. The use of these light and heavy DRC values is typically tied to operation at decoder loudness target levels established for the operating modes "Line Mode" and "RF Mode". The naming conventions and operation points for these modes were established in the early days of digital media when it might have been necessary to convert digital audio to analog signals sent over baseband cables to line inputs on a succeeding device or transmitted over an RF carrier to an analog television set.

The use of this metadata allows the reproduction to be tailored to the listening environment in a non-destructive manner during playback. The same stream or file may be played back with a different set of metadata, or no metadata used at all, to produce a different dynamic range. Unlike the use of a compressor that resides solely in the playback device, dynamic range control using metadata allows monitoring and control of the nature of the compression by creative artists during the production process, if desired.

Unfortunately, dynamic range control metadata as commonly implemented in lossy codecs such as MPEG AAC or the Dolby Digital family cannot compress a signal strongly enough to match the loudness of contemporary music, as the metadata affects the average power of the signal (potentially in several frequency bands) on an audio compression frame basis, with common frame periods of 20-40 ms. This frame-by-frame gain control is not quick enough to reduce the peak to average ratio of the signal to that of highly processed contemporary music.

The approach taken by Wolters et al as described in [5] to solve this problem is to employ an audio limiter following the decoder in a playback device to increase the average loudness. This will solve the loudness matching issue, so that music and film content have equal loudness, but has several disadvantages. When a consumer is playing content in a quiet environment, perhaps with the mobile device connected to speakers in a quiet room or using headphones or earphones with strong acoustic isolation, the film content will be undesirably compressed as strongly as the music.

Also, the limiter introduces additional workload on the device CPU or DSP, shortening battery life.

A different approach is described by Camerer et al in [6] which proposes encoding a loudness measurement such as described in ITU Standard BS.1770-2 as metadata in music files and normalizing the playback of each file to a target level set by the device's volume control. This builds upon previous systems of music loudness normalization such as SoundCheck (www.apple.com) and ReplayGain (www.replaygain.org), which have been optional features of some music players such as the iPod. In their approach, they advocate mandating loudness normalization as on by default; however, they do not specify what is to happen when a user turns off the loudness normalization, or more importantly, what happens when content which has not been encoded with loudness metadata is played back. Their assumption is that all content will be analyzed by the playback device or by a secure trusted distributor such as iTunes before playback. Additionally, there is no provision for adjusting the overall dynamic range of the content to tailor it to the listening environment.

Therefore, it is an object of the invention to provide a unified approach to the problem of normalizing playback loudness of both film/video style content, with potentially wide dynamic range and possible embedded loudness metadata, and music or radio/podcast content, with potentially extremely narrow dynamic range and strong compression, limiting, and clipping, potentially, but likely not containing embedded loudness metadata, due to the vast amount of prior music content already held or exchanged by consumers.

It is another object of this invention to allow the dynamic range of content containing dynamic range control metadata to be adjusted to the consumer's listening environment or taste.

A further object of this invention is to prevent potential clipping in lossy data-compression audio decoders, such as an AAC, MP3, or Dolby Digital decoder, caused by the changes in signal components introduced by the data compression process.

A further object of this invention is to provide a mild incentive for the music recording industry to abandon pursuit of ever-stronger dynamic range compression, limiting, and clipping in their content.

Still another object of this invention is to limit the additional workload on the device CPU or DSP caused by loudness processing or clipping prevention.

SUMMARY

According to an embodiment, a decoder device for decoding a bitstream so as to produce therefrom an audio output signal, the bitstream having audio data and optionally loudness metadata containing a reference loudness value, may have: an audio decoder device configured to reconstruct an audio signal from the audio data; and a signal processor configured to produce the audio output signal based on the audio signal; wherein the signal processor has a gain control device configured to adjust a loudness level of the audio output signal; wherein the gain control device has a reference loudness decoder configured to create a loudness value, wherein the loudness value is the reference loudness value in case that the reference loudness value is present in the bitstream; wherein the gain control device has a gain calculator configured to calculate a gain value based on the loudness value and based on a volume control value, which is provided by an user interface allowing a user to control the volume control value; wherein the gain control device has a loudness processor configured to control the loudness level of the audio output signal based on the gain value.

According to another embodiment, a system may have a decoder device and an encoder, wherein the decoder device is designed as mentioned above.

According to another embodiment, a method of decoding a bitstream so as to produce therefrom an audio output signal, the bitstream having audio data and optionally loudness metadata containing a reference loudness value, may have the steps of: reconstrutting an audio signal from the audio data using an audio decoder device; and producing the audio output signal based on the audio signal using a signal processor; wherein a loudness level of the audio output signal is adjusted using a gain control device contained by the signal processor; wherein a loudness value is created by a reference loudness decoder contained by the gain control device, wherein the loudness value is the reference loudness value in case that the reference loudness value is present in the bitstream; wherein a gain value is calculated based on the loudness value and based on a volume control value, which is provided by an user interface allowing a user to control the volume control value, by a gain calculator contained by the gain control device; wherein the loudness level of the audio output signal is controlled based on the gain value by a loudness processor contained by the gain control device.

Another embodiment may have a computer program for performing, when running on a computer or a processor, the above method.

The audio decoder device may be any device which is capable of reconstructing an audio signal from the audio data of the compressed bitstream. The signal processor may be any device which is able to produce the audio output signal when the audio signal from the audio decoder device is set to it and which has a gain control device as explained below. The gain control device is a device which is set up to control the loudness of the audio output signal.

The reference loudness decoder is configured to decode loudness metadata contained in the bitstream. If the loudness metadata contain a reference loudness value, the reference loudness decoder outputs just this reference loudness value as a loudness value.

The gain calculator is a device for calculating a gain value which is based on the loudness value outputted by the reference loudness decoder and a volume control value set by a user of the decoder device. For setting the volume control value any user interface may be used. The gain calculator in particular may be a subtractor.

The loudness processor is capable of controlling the loudness level of the audio output signal based on the gain value provided by the gain calculator. The loudness processor may be in particular a multiplier.

Unlike a traditional compressed decoder device, such as a Dolby Digital or AAC decoder device, used in portable devices or in consumer electronic equipment, a compressed decoder device is operated with a variable gain value or decoder target threshold value (corresponding to the decoded level of a full-scale bitstream) which is controlled by the user's volume control. This allows the decoder device to normally operate well below the maximum full-scale range of the device's digital audio system. Such operation avoids the possibility of clipping decoder overshoots and allows the loudness normalization of film-style content without heavy dynamic range compression and limiting to that of music content with heavy compression and limiting, without further compression or limiting of the film-style content, as is normally necessitated. The invention performs this normalization without reducing the dynamic range of content solely for the purpose of loudness matching.

In an embodiment of the invention the loudness value is a preset loudness value in case that the reference loudness value is not present in the bitstream. These features allow a high quality playback of bit streams having no loudness metadata.

In an embodiment of the invention the preset loudness value is set to a value between −4 dB and −10 dB, in particular between −6 dB and −8 dB, referenced to a full-scale amplitude. Empirical studies of contemporary music show that the observed upper limit of loudness for music content that is intended for full-scale playback is about −7 dB. Hence, preset loudness values as claimed provide an optimized mode for playbacking bit streams having no loudness metadata.

In an embodiment of the invention the signal processor comprises a dynamic range control device configured to adjust a dynamic range of the audio output signal, wherein the dynamic range control device comprises a dynamic range control switch configured to derive at least one dynamic range control value from the loudness metadata and to output alternatively one of the derived dynamic range control values or a preset dynamic range control value, wherein the dynamic range control device comprises a dynamic range calculator configured to calculate a dynamic range value based on the dynamic range control value outputted by the dynamic range control switch and based on a compression control value, which is provided by an user interface allowing a user to control the compression control value;

wherein the dynamic range control device comprises a dynamic range processor configured to control the dynamic range of the audio output signal based on the dynamic range value.

The dynamic range control device comprises a dynamic range control switch which is configured to decode the loudness metadata of the bitstream in such way that at least one dynamic range control value may be derived. Typically the dynamic range control switch is configured in such way that one dynamic range control value for light dynamic range control and another dynamic range control value for heavy dynamic range control may be derived. The dynamic range control switch may output one of these derive dynamic range control values or a preset dynamic range control value alternatively. The dynamic range control switch may be controlled automatically, for example depending on the subsequent equipment using the audio output signal, or manually by a user action. The preset dynamic range control value may be set for example to 0 dB.

The dynamic range control device may comprise a dynamic range calculator which is capable of calculating a dynamic range value based on the dynamic range control value outputted by the dynamic range control switch and based on a compression control value, which is provided by an user interface allowing a user to control the compression control value. The dynamic range calculator may in particular be a multiplier.

Furthermore, a dynamic range processor is foreseen which is capable of controlling the dynamic range of the audio output signal based on the dynamic range value. By these features the playback of the bitstream may be adapted through the listening environment and/or to the listeners taste.

According to an embodiment of the invention the signal processor comprises a limiter device configured to limit an amplitude of the output audio signal, wherein the limiter device comprises a limiter component having a limiter and a control component configured to control the limiter component, wherein a processed audio signal, which is derived from the audio signal by being processed at least by the gain control device, is inputted to the limiter component, and wherein the audio output signal is outputted from the limiter component.

The limiter device provides limiting for the purpose of decoder overshoot clipping prevention, volume limiting for hearing loss prevention or user preference, and artistic compression to allow reversible generation of content with peak limiting when needed due to the listening environment or user taste.

According to an embodiment of the invention the control component is configured to control the limiter component depending on a bit rate of the bitstream. The likelihood of decoder overshoot clipping increases when the bit rate is lowered. Therefore, decoder overshoot clipping prevention is enhanced when the limiter component is controlled depending on the bit rate of the bitstream.

According to an embodiment of the invention the control component is configured to control the limiter component depending on a compression efficiency of the audio decoder device. The compression efficiency of an audio encoder device producing the bitstream and at the same time of the audio decoder device decoding the bitstream describes how much the data quantity is reduced when encoding the original audio data in order to produce the bitstream. As more as the data quantity is reduced the likelihood of decoder overshoot clipping increases. Hence, decoder overshoot clipping prevention is enhanced when the limiter component is controlled depending on the compression efficiency of the audio decoder device.

According to an embodiment of the invention the control component is configured to control the limiter component depending on a true peak value transmitted in the loudness metadata of the bitstream and indicating a maximum peak level of an audio source converted to the bitstream by an external encoder. The use of this true peak value allows the computation of a more accurate value for the maximum possible peak level of the audio output signal.

According to an embodiment of the invention the control component is configured to control the limiter component depending on the gain value of the gain control device. The maximum possible peak level of the audio output signal is determined in this sub-case by the gain value of the gain control device. If said value is 0 dB, the decoder device is operating at its full-scale limits as commanded by the maximum setting of volume control value. As said volume control value is reduced, the decoder device will operate such that full-scale bitstream values reach only the maximum level set by the gain value of the gain control device.

According to an embodiment of the invention the control component is configured to control the limiter component depending on a volume limit value set by the user or manufacturer in order to prevent hearing damage. By these features hearing damages may be avoided efficiently.

According to an embodiment of the invention the control component is configured to control the limiter component depending on artistic limiter parameters transmitted in the loudness metadata of the bitstream and indicating artistic limiter threshold values, artistic limiter attack time values and/or artistic limiter release time values. These features allow the operation of the limiter device to be under the creative control of the artist or content creator. The dynamic range control values contained in the loudness metadata discussed previously allow the overall dynamic range of the content to be tailored to the listening environment through the use of compression gains that act with typical time constants of 100 ms to 3 seconds. In challenging listening environments, compression of the audio signal with these time constants may not produce a signal with sufficient loudness for intelligibility or enjoyment without unpleasantly high peak levels. There is also the possibility that music creators, who have traditionally produced only a highly compressed "crushed" mix, may desire to use the flexibility of this invention to produce both a "crushed" mix and an "uncrushed" mix with less limiting and compression, so that consumers may hear the "uncrushed" version in quiet environments or when desired.

According to an embodiment of the invention the control component is configured to control the limiter component continually or repeatedly. These features allow variable controlled of the limiter component over time.

According to an embodiment of the invention the limiter device is configured to bypass the limiter by way of a bypass device having a transfer function which is, regarding a gain and a delay, similar to a transfer function of the limiter. By these features the work load of the signal processor may be reduced significantly.

One embodiment of the invention includes a system comprising a decoder and an encoder, wherein the decoder is designed as claimed.

One embodiment of the invention includes a method of decoding a bitstream so as to produce therefrom an audio output signal, the bitstream comprising audio data and optionally loudness metadata containing a reference loudness value, the method comprising the steps:

reconstructing an audio signal from the audio data using an audio decoder device; and producing the audio output signal based on the audio signal using a signal processor;

wherein a loudness level of the audio output signal is adjusted using a gain control device comprised by the signal processor;

wherein a loudness value is created by a reference loudness decoder comprised by the gain control device, wherein the loudness value is the reference loudness value in case that the reference loudness value is present in the bitstream;

wherein a gain value is calculated based on the loudness value and based on a volume control value, which is provided by an user interface allowing a user to control the volume control value, by a gain calculator comprised by the gain control device;

wherein the loudness level of the audio output signal is controlled based on the gain value by a loudness processor comprised by the gain control device.

One embodiment of the invention includes a computer program for performing, when running on a computer or a processor, the method as claimed herein.

BRIEF DESCRIPTION OF THE DRAWINGS

Embodiments of the invention are subsequently discussed with respect to the accompanying drawings, in which.

DETAILED DESCRIPTION OF THE INVENTION

Figure 1:
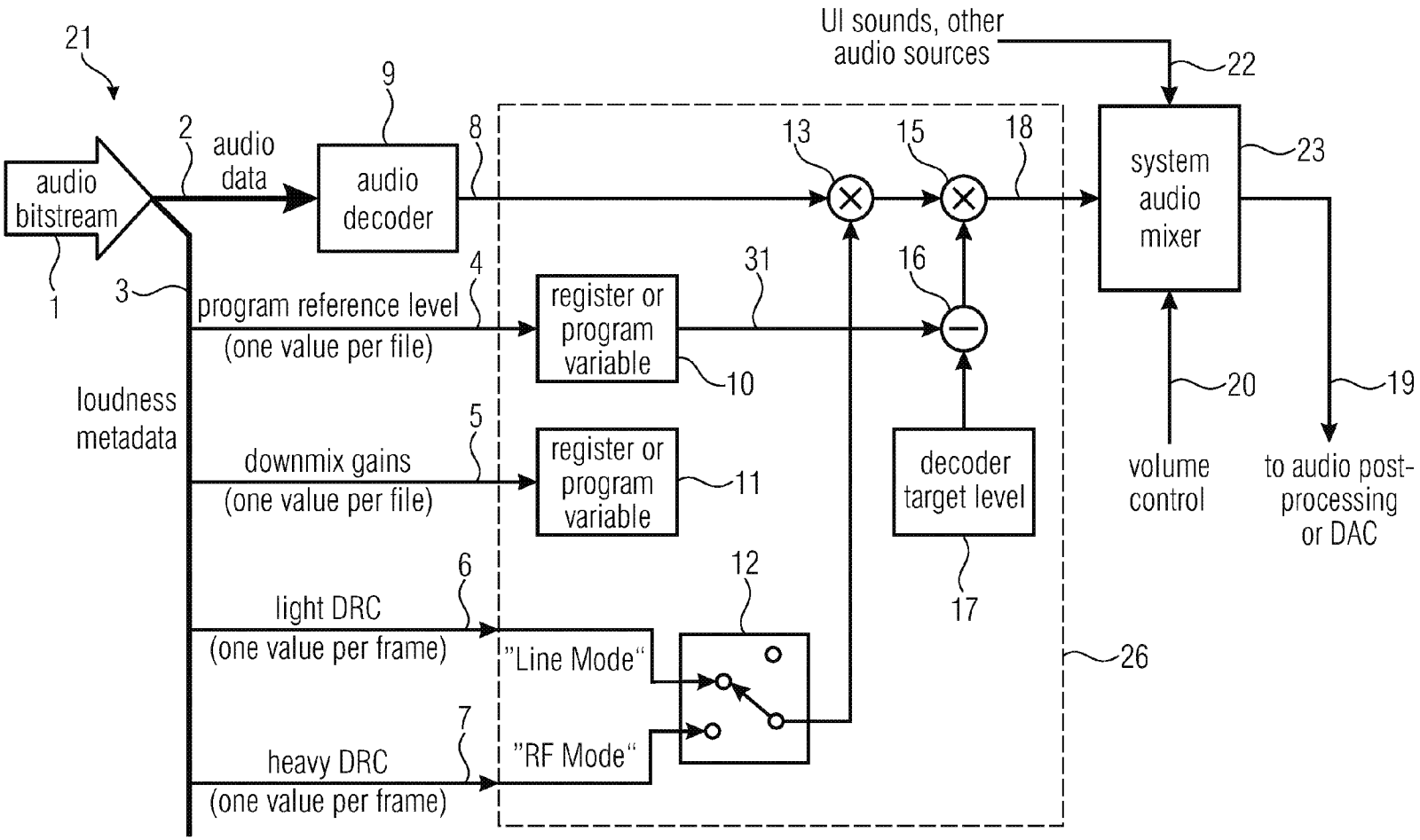
FIG 1 (PRIOR ART)
FIG. 1 shows a block diagram of an existing known data-compressed decoder device with loudness metadata support, such as specified by ISO/IEC 14496-3 and ETSI TS 101 154, as integrated into a typical mobile phone, tablet computer, or portable media player.

As an aid to understanding the operation of the invention, the operation of an existing known metadata-enabled data-compressed decoder device 21, such as specified by ISO/IEC 14496-3 and ETSI TS 101 154, as integrated into a typical mobile phone, tablet computer, or portable media player, is presented in FIG. 1. A compressed audio bitstream 1 may include both the compressed audio essence data 2 and the loudness metadata 3. The decoder device 21 comprises an audio decoder device 9 configured to reconstruct an audio signal 8 from the audio data 2; and a signal processor 26 configured to produce the audio output signal 18 based on the audio signal 8. The loudness metadata 3 include a reference loudness value 4 for the overall integrated loudness of the entire file, program, song, or album, known as the program reference level in ISO/IEC 14496-3. This reference loudness value 4 may be transmitted in the bitstream 1 once per file or at a repetition rate sufficient to allow a broadcast bitstream 1 to be joined while the program is in progress. This reference loudness value 4 is compared to a fixed decoder target level value, which is provided by a static target level provider 17, by gain calculator 16, which is designed as subtractor 16. The output of the gain calculator 16 is the difference in loudness between the incoming bitstream 1 and the desired target level. This is applied to loudness processor 15, which is designed as a multiplier 15, to adjust the level of the audio output signal 18 so that the target long-term loudness for the song or program is attained.

Dynamic range control switch 12 allows the application of either light dynamic range control values 6, as typically used in "Line Mode" or heavy dynamic range control values 7, as typically used in "RF Mode", or none at all. These values 6, 7 are sent for each data-compressed bitstream frame for a plurality of frequency bands or regions in the bitstream 1 and applied to a dynamic range processor 13, which is designed as a multiplier 13, to change the output level of the audio decoder device 9 so that the short-term (on the order of seconds) loudness of the audio output signal 18 is compressed according to the desired dynamic range. Typically, the decoder target level provided by the static target lever provider 17 is also adjusted with the selection of 12 to −20 dB for RF Mode and −31 dB for Line Mode. The operation of the dynamic range control values 6 and/or 7 are usually pre-computed so that any increase in level created by the operation of multiplier 16 in combination with multiplier 13 is controlled such that clipping at the audio output signal 18 is prevented.

The metadata 3 also contain downmix gain values 5 which are used to adjust the mixing of the channels of multi-channel content (such as a 5.1 channel surround program) into a stereo or mono output when needed. As the invention may be applied to bitstream 1 containing any number of channels, this feature is not discussed further.

Importantly, if there is no reference loudness value 4 present in a given bitstream 1, the loudness value 31 outputted by the reference loudness decoder 10 is set equal to the decoder target level outputted by the static target level provider 17 so that there is no gain adjustment of the audio output signal 18, and the decoder device 21 operates as a simple decoder device with its output range equal to the full-scale dynamic range of the audio output signal 18.

The output of the decoder device 21 is then typically supplied to a system audio mixer 23 where the audio output signal 18 is combined with user interface sounds (UI sounds), ringing tones or other audio signals 22 so that a mixed audio signal 19 is created. The overall volume is controlled by volume control value 20. The operation of the audio signal mixer 23 may include secondary volume controls for adjusting the relative levels of each type of audio signal or changing their amplitude depending on the device's mode of operation, which are not pertinent to understanding the operation of the invention. What is important is that the audio output signal 18 of the decoder device 21 is typically scaled so that a full-scale output signal corresponds to a maximum fixed-point or nominal full-scale (typically in the range −1.0 to 1.0) floating point value. With heavily compressed audio data, as is typical for contemporary music, the decoder output signal 18 will have peaks that approach its full scale values when listening at nominal listening levels. Thus a 0 dB FS (referenced to the full-scale amplitude of the audio output signal) full-scale peak on audio output signal 18 will be attenuated in the system audio mixer 23 and correspond to a sound pressure level (SPL) at the listener's ears of perhaps 75 dB SPL when listening in a quiet environment.

Figure 2:
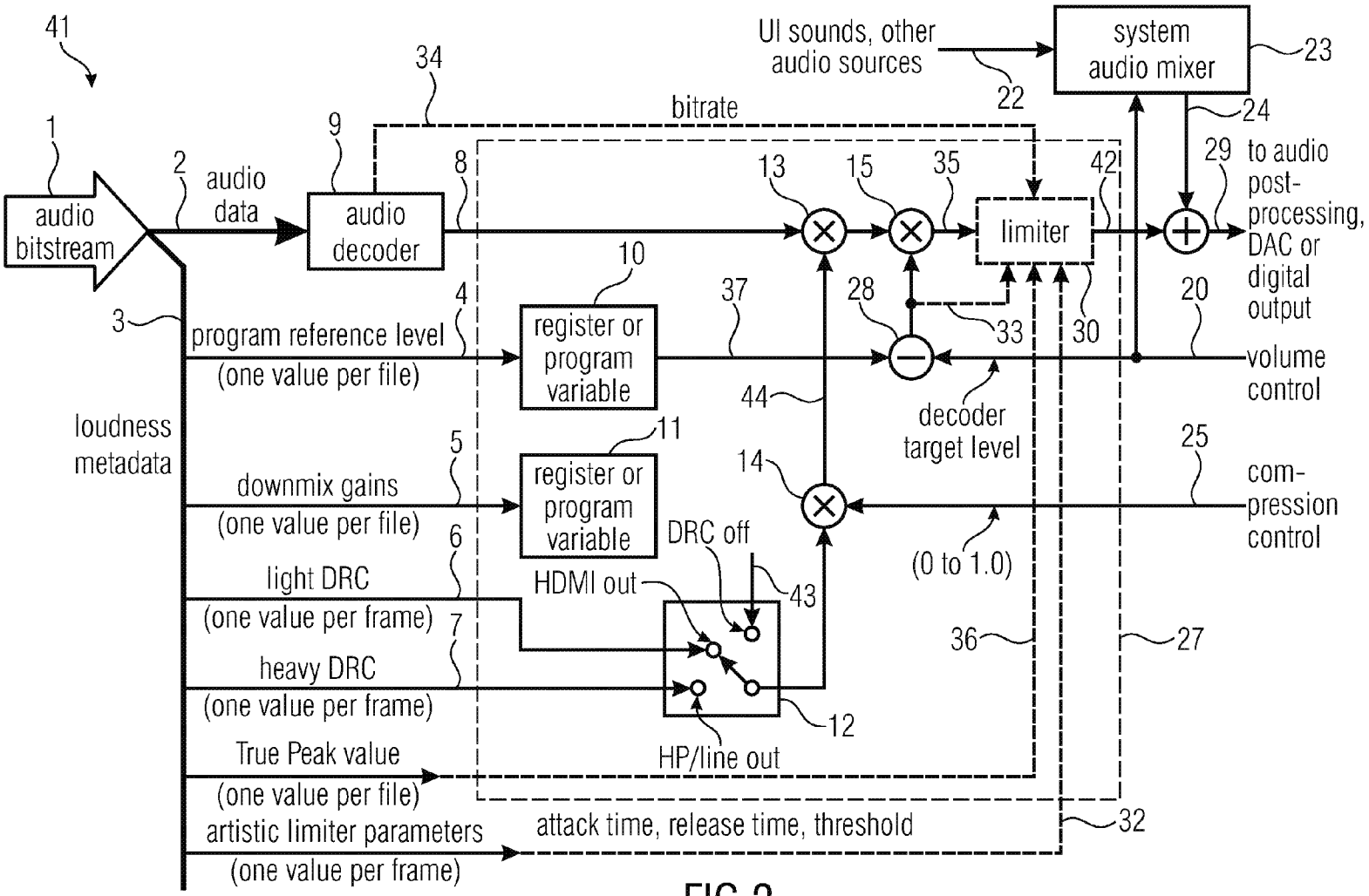
FIG. 2 shows an embodiment of a decoder device with a data-compressed audio decoder device and an optional audio limiter according to the invention, which is suitable for integration into a typical mobile phone, tablet computer, or portable media player.

FIG. 2 depicts a decoder device 41 for decoding a bitstream 1 so as to produce therefrom an audio output signal 42, the bitstream 1 comprising audio data 2 and optionally loudness metadata 3 containing a reference loudness value 4, the decoder device 41 comprising:

an audio decoder device 9 configured to reconstruct an audio signal 8 from the audio data 2; and a signal processor 27 configured to produce the audio output signal 42 based on the audio signal 8;

wherein the signal processor 27 comprises a gain control device 10, 15, 28 configured to adjust a level of the audio output signal 42;

wherein the gain control device 10, 15, 28 comprises a reference loudness decoder 10 configured to create a loudness value 37, wherein the loudness value 37 is the reference loudness value 4 in case that the reference loudness value 4 is present in the bitstream 1;

wherein the gain control device 10, 15, 28 comprises a gain calculator 28 configured to calculate a gain value 33 based on the loudness value 37 and based on a volume control value 20, which is provided by an user interface allowing a user to control the volume control value 20;

wherein the gain control device 10, 15, 28 comprises a loudness processor 28 configured to control the loudness of the audio output signal 42 based on the gain value 33.

The audio decoder device 9 may be any device 9 which is capable of reconstructing an audio signal 8 from the audio data 2 of the compressed bitstream 1. The signal processor 37 may be any device 37 which is able to produce the audio output signal 42 when the audio signal 8 from the audio decoder device 9 is fed to it and which has a gain control device 10, 15, 28 as explained below. The gain control device 10, 15, 28 is a device which is set up to control the loudness of the audio output signal 42.

The reference loudness decoder 10 is configured to decode loudness metadata 3 contained in the bitstream 1. If the loudness metadata 3 contain a reference loudness value 4, the reference loudness decoder 10 outputs just this reference loudness value 4 as a loudness value 37.

The gain calculator 28 is a device for calculating a gain value 33 which is based on the loudness value 37 outputted by the reference loudness decoder 10 and a volume control value 20 set by a user of the decoder device 41. For setting the volume control value 20 any user interface may be used. The gain calculator 28 in particular may be a subtractor 28.

The loudness processor 15 is capable of controlling the loudness level of the audio output signal 42 based on the gain value 33 provided by the gain calculator 28. The loudness processor 15 may be in particular a multiplier 15.

Unlike a traditional compressed decoder device 21, such as a Dolby Digital or AAC decoder device, used in portable devices or in consumer electronic equipment, the compressed decoder device 41 is operated with a variable gain value 33 or decoder target threshold value 33 (corresponding to the decoded level of a full-scale bitstream) which is controlled by the user's volume control. This allows the decoder device 41 to normally operate well below the maximum full-scale range of the device's digital audio system. Such operation avoids the possibility of clipping decoder overshoots and allows the loudness normalization of film-style content without heavy dynamic range compression and limiting to that of music content with heavy compression and limiting, without further compression or limiting of the film-style content, as is normally necessitated. The invention performs this normalization without reducing the dynamic range of content solely for the purpose of loudness matching.

In an embodiment of the invention the loudness value 37 is a preset loudness value 37 in case that the reference loudness value 4 is not present in the bitstream 1. These features allow a high quality playback of bitstreams 1 having no loudness metadata 3.

In an embodiment of the invention the preset loudness value 37 is set to a value between −4 dB and −10 dB, in particular between −6 dB and −8 dB, referenced to a full-scale amplitude. Empirical studies of contemporary music show that the observed upper limit of loudness for music content that is intended for full-scale playback is about −7 dB. Hence, preset loudness values 37 as claimed provide an optimized mode for playbacking bitstreams having no suitable loudness metadata 3.

In an embodiment of the invention the signal processor 27 comprises a dynamic range control device 12, 13, 14 configured to adjust a dynamic range of the audio output signal 42, wherein the dynamic range control device 12, 13, 14 comprises a dynamic range control switch 12 configured to derive at least one dynamic range control value 6, 7 from the loudness metadata 3 and to output alternatively one of the derived dynamic range control values 6, 7 or a preset dynamic range control value 43, wherein the dynamic range control device 12, 13, 14 comprises a dynamic range calculator 14 configured to calculate a dynamic range value 44 based on the dynamic range control value 6, 7, 43 outputted by the dynamic range control switch 12 and based on a compression control value 25, which is provided by an user interface allowing a user to control the compression control value 25;

wherein the dynamic range control device 12, 13, 14 comprises a dynamic range processor 13 configured to control the dynamic range of the audio output signal 42 based on the dynamic range value 44.

The dynamic range control device 12, 13, 14 comprises a dynamic range control switch 12 which is configured to decode the loudness metadata 3 of the bitstream 1 in such way that at least one dynamic range control value 6, 7 may be derived. Typically the dynamic range control switch 12 is configured in such way that one dynamic range control value 6 for light dynamic range control and another dynamic range control value 7 for heavy dynamic range control may be derived. The dynamic range control switch 12 may output one of these derive dynamic range control values 6, 7 or a preset dynamic range control value 43 alternatively. The dynamic range control switch 12 may be controlled automatically, for example depending on the subsequent equipment using the audio output signal 42, or manually by a user action. The preset dynamic range control value may be set for example to 0 dB.

The dynamic range control device 12, 13, 14 may comprise a dynamic range calculator 14 which is capable of calculating a dynamic range value 44 based on the dynamic range control value 6, 7, 43 outputted by the dynamic range control switch 12 and based on a compression control value 25, which is provided by an user interface allowing a user to control the compression control value 25. The dynamic range calculator 14 may in particular be a multiplier 14.

Furthermore, a dynamic range processor 13 is foreseen which is capable of controlling the dynamic range of the audio output signal 42 based on the dynamic range value 44. By these features the playback of the bitstream 1 may be adapted through the listening environment and/or to the listeners taste.

FIG. 2 shows the operation of an embodiment of the invention as contained in an improved audio decoder 41. The incoming audio bitstream 1 consists of audio essence data 2 and optional loudness metadata 3 containing the aforementioned standard metadata values for program reference level 4, downmix gains 5, light DRC values 6 and heavy DRC values 7. The metadata 3 may also include artistic limiter parameters 32 and true peak values 36 which are used in an optional embodiment.

In contrast to the operation previously described in FIG. 1, the loudness value 37 outputted by the reference loudness decoder 10 is compared to the volume control value 20 of the volume control so that the multiplier 15 is used to adjust the audio output signal 42 of the decoder device 41 to the desired listening level. Said audio output signal 41 is then added to the loudness adjusted supplementary audio signal 24 of the system audio mixer 23 to form the mixed audio signal 29 sent to succeeding audio post-processing functions in the device or directly to the digital to analog converter (DAC) and therefrom to loudspeakers, or to an digital output of the device, such as would commonly occur when the device is connected to other equipment through HDMI, MHL, S/PDIF, AES, TosLink, AirPlay, or other wired or wireless digital interface standards.

Importantly, the audio output signal 42 in this invention is not typically operated at full-scale values. 0 dB FS of the audio output signal 42 now corresponds to the maximum sound pressure level possible with the decoder device 41 and, depending on the connected earphones, speakers, or other transducers, perhaps to the range of 110-120 dB SPL with typical earphones.

If there is no value 4 present in a given bitstream 1, the loudness value 37 is set to a level of −7 dB FS. Empirical studies of contemporary music (such as in [5]) show this is the observed upper limit of loudness for music content that is intended for full-scale playback. This provides a mild incentive for music creators and distributors to prepare versions of their content without heavy limiting, compression, or clipping for distribution to devices or distribution ecosystems that utilize this invention, as their content will then be distributed with loudness metadata 3 that will enable their content to be reproduced as loud or louder than a traditional "crushed" version of the content.

As in the known decoder of FIG. 1, the dynamic range control switch 12 again allows selection of no dynamic range modification, or the application of either the light dynamic range control value 6 or the heavy dynamic range control value 7. For example, in a mobile phone the light dynamic range control value 6 may be applied when the phone is connected to an external audio system over HDMI and the heavy dynamic range control value 7 may be applied when the headphone jack is used. These dynamic range control values (or a static preset dynamic range control value 43, which may be set to zero, if there is no dynamic range control applied, are then fed to multiplier 14 which scales the dynamic range control values in accordance with a new user compression control value 25 which varies over a 0 to 1 range. Compression control value 25 allows the dynamic range control values 6, 7, 43 to be scaled such that a variable amount of dynamic range compression may be applied to the audio output signal 42, independent of the listening level. The value of compression control value 25 may be obtained from a user-interface control element in the decoder device 41, from presets corresponding to modes of the device 41 or its location or configuration, from estimates of ambient noise obtained by the decoder device 41, from empirically obtained functions of overall volume setting or output level, or through other means. The output 44 of the multiplier 14 containing the scaled dynamic range control values is then applied to the multiplier 13 in the usual manner, with multiplier 13 modifying the loudness of the audio signal 8 of audio decoder device 9 for further modification by the multiplier 15. The processed audio signal 35 outputted by multiplier 15 (or in other embodiments outputted by the multiplier 13) is connected to the limiter device 30 of an optional embodiment explained below, or directly used as the audio output signal 42.

It will be understood by those skilled in the art that there may be a need for a offset or scaling of the volume control value 20 either in the system audio mixer 23 or the subtractor 28 so that the volume of the mixed audio signal 29 tracks in loudness with the loudness adjusted supplementary audio signal 24.

In prior approaches to matching loudness of content of various genres, such as in [5], a limiter was employed in the signal chain following the core audio decoder and application of dynamic range control metadata in order to limit the signal peaks and thus increase the average level of the signal without clipping. Such a limiter should operate in a manner that limits the signal peaks in a "soft" manner by varying the signal gain as the signal waveform approaches or exceeds a threshold value, as opposed to a "hard" limiter or clipper that simply implements a mathematical saturation at a threshold level, to avoid introducing audible artifacts into the signal. Such soft limiters are computationally expensive, potentially consuming 10-30% of the workload incurred by the decoder device.

In contrast, the present invention does not require a limiter for control of the peak to average ratio of the audio output signal 42 for the purpose of loudness matching, but may include the optional limiter device 30 for the purposes of protection against clipping, for limiting to avoid hearing damage, and for limiting for artistic effect or compression increase. A particular decoder device 41 may be equipped with the limiter device 30 for any or all of these purposes with varying costs of implementation, or the limiter device 30 may be simply omitted. Each of these cases is explained below.

Figure 3:
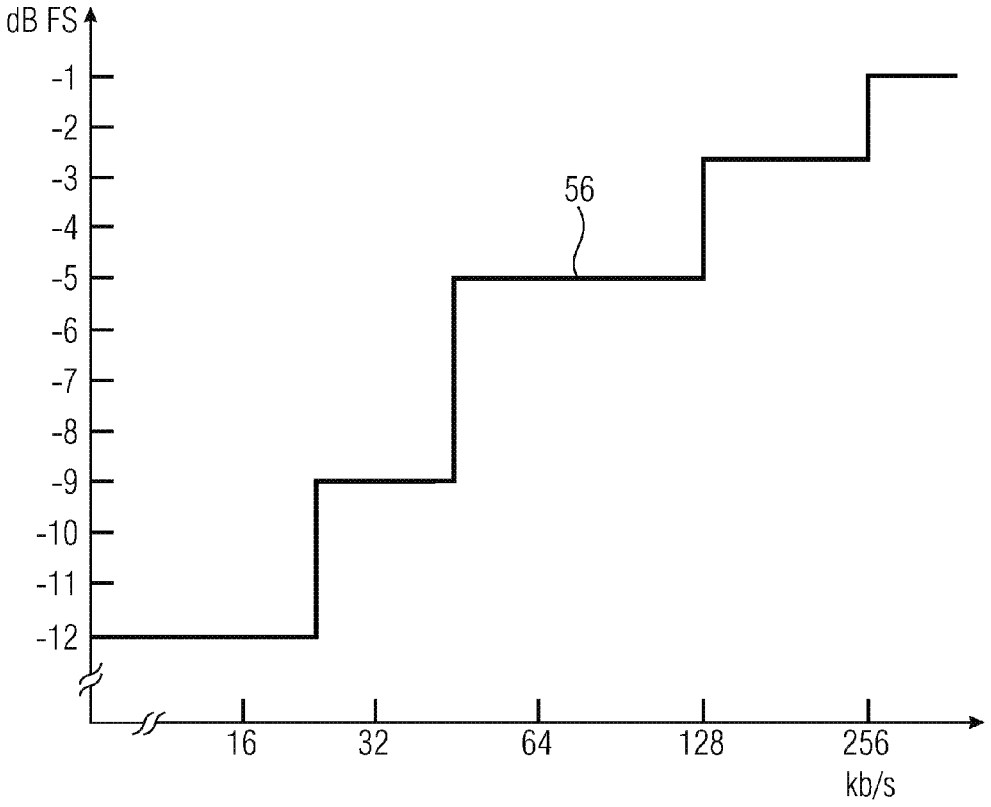
FIG. 3 shows an empirically derived function of the possible additional clipping due to the overshoot of the reconstructed signal waveform in an AAC-LC stereo decoder versus the bitstream bit rate.

In considering the case of clipping protection, two sub-cases of signals must be considered: Some bitstreams 1 may not contain any metadata 3, such as legacy music content already present on the user's device which has not been analyzed for loudness or dynamic range. In this sub-case, the multiplier 13 is not active, and the multiplier 15 provides a maximum gain of unity at the highest volume control setting. Thus, the only potential for clipping is the possibility of data-compression induced overshoots in the signal waveform. The amount of potential overshoot possible with ordinary signals may be empirically determined for a compression codec within a confidence interval as a function of the bits per sample per channel or similar metric of compression ratio. A typical empirically determined clipping prediction function 56 for AAC LC stereo bitstreams is shown in FIG. 3. It should be understood by those skilled in the art that other methods, empirical, analytic, or iterative, may be used to determine or predict the amount of clipping that may be present.

Figure 4:
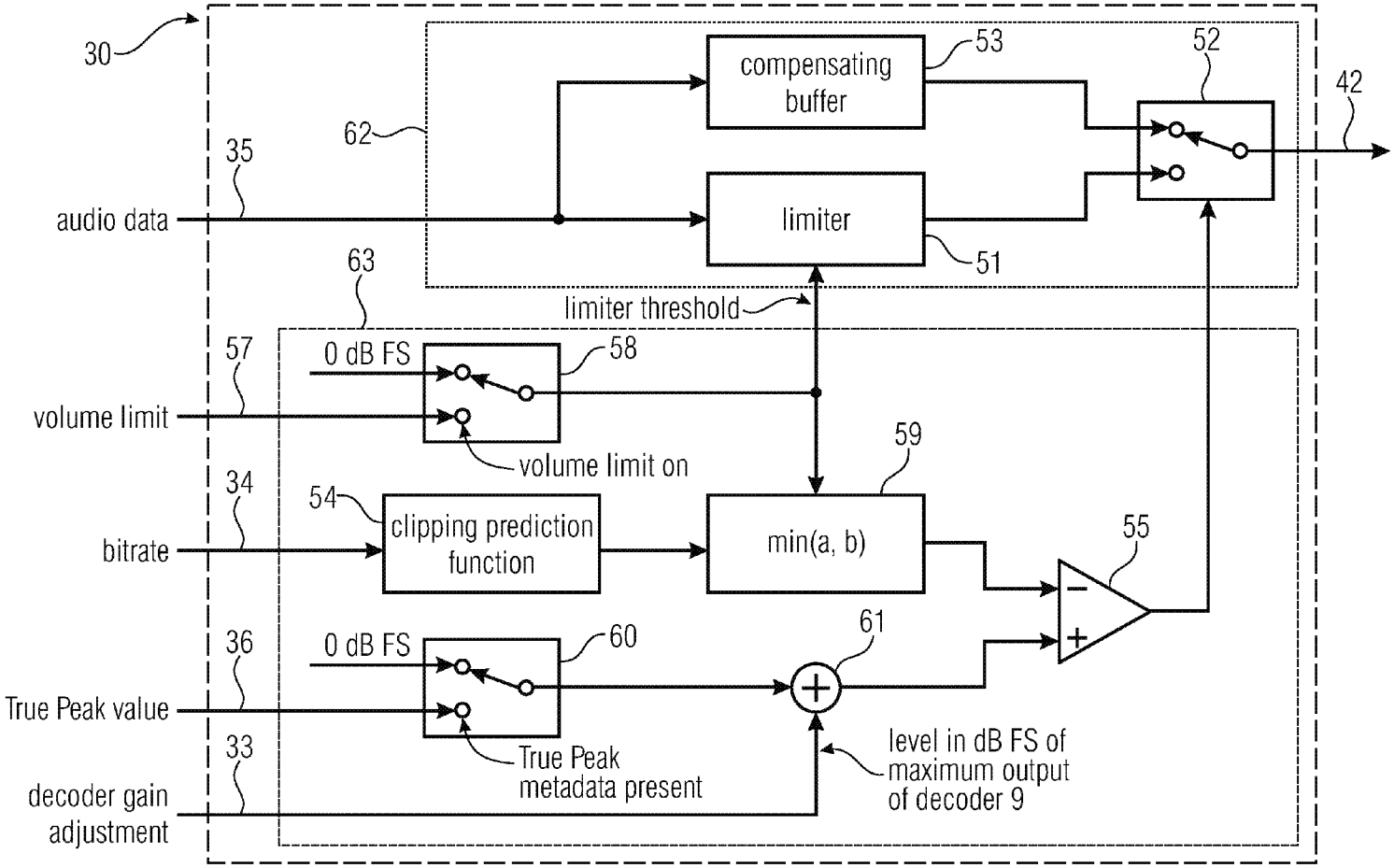
FIG. 4 shows a block diagram of an embodiment of the optional limiter device according to the invention.
Figure 5:
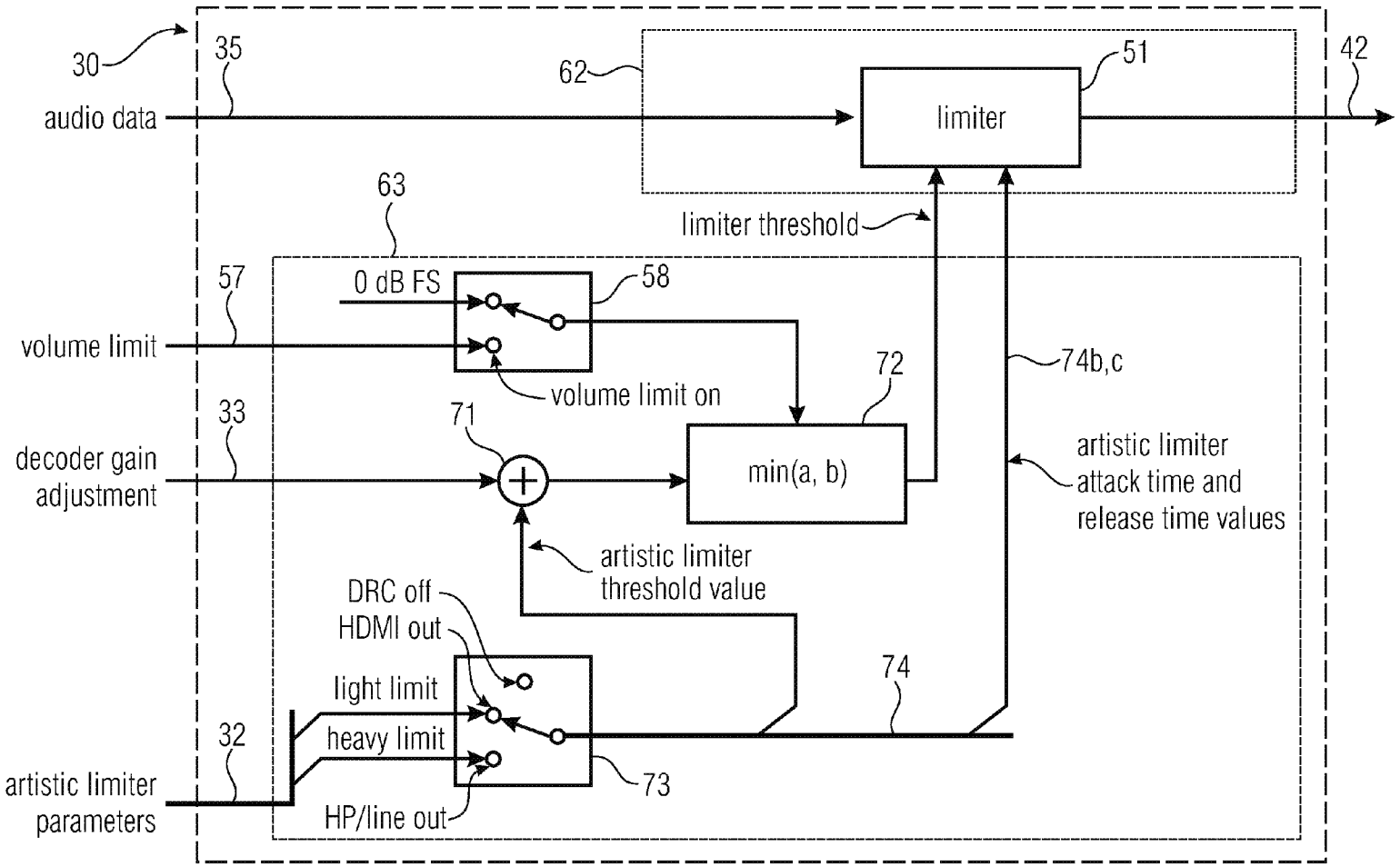
FIG. 5 shows a block diagram of an embodiment of the optional limiter device operating in an artistic limiting mode according to the invention.

According to an embodiment of the invention shown in FIGS. 4 and 5 the signal processor 27 comprises a limiter device 30 configured to limit an amplitude of the output audio signal 42, wherein the limiter device 30 comprises a limiter component 62 having a limiter 51 and a control component 63 configured to control the limiter component 62, wherein a processed audio signal 35, which is derived from the audio signal 8 by being processed at least by the gain control device 10, 15, 28, is inputted to the limiter component 62, and wherein the audio output signal 42 is outputted from the limiter component 62.

The limiter device 30 provides limiting for the purpose of decoder overshoot clipping prevention, volume limiting for hearing loss prevention or user preference, and artistic compression to allow reversible generation of content with peak limiting when needed due to the listening environment or user taste.

The limiter 51 is controlled by internal signals or supplied peak level or artistic metadata, which provides limiting for the purpose of decoder overshoot clipping prevention, volume limiting for hearing loss prevention or user preference, and artistic compression to allow reversible generation of content with peak limiting when needed due to the listening environment or user taste.

Limiter 51 is ideally an efficient, non-clipping, look-ahead limiter such as commonly used for digital audio mastering and known to those skilled in the art. For example, it may be an implementation such as described in [8]. Alternatively, if clipping protection is not a desired feature, but volume limiting is, a hard clipper with threshold set by the output of 58 may substituted and the compensating buffer 53 removed or shortened.

According to an embodiment of the invention shown in FIG. 4 the control component 63 is configured to control the limiter component 62 depending on a bit rate of the bitstream 1. The likelihood of decoder overshoot clipping increases when the bit rate is lowered. Therefore, decoder overshoot clipping prevention is enhanced when the limiter component 62 is controlled depending on the bit rate of the bitstream 1.

In an embodiment of this optional feature, the bit rate value 34 of the bitstream 1 being decoded by the audio decoder device 9 is input to a clipping prediction device 54, which comprises a clipping prediction function 56 implemented in logic statements or gates, as a look-up table, or by other techniques of implementing a function of at least one variable as will be known to those skilled in the art. The output of the function 56 is fed through a minimum function 59, similarly implemented, which selects the lesser of its two inputs, to comparator 55. We consider here that the volume limit feature described below is not active and the switch 58 outputs a value corresponding to 0 dB FS (full scale) thus that the minimum function 59 is controlled by the output of the clipping prediction function 56. In this manner comparator 55 compares the output of the clipping protection function 56 to the maximum possible peak level of the processed audio signal 35 to determine if it is necessitated to engage the limiter 51 via limiter switch 52 to protect against clipping at the audio output signal 42.

According to an embodiment of the invention the control component is configured to control the limiter component 62 depending on a compression efficiency of the audio decoder device 9. The compression efficiency of an audio encoder device producing the bitstream and at the same time of the audio decoder device 9 decoding the bitstream 1 describes how much the data quantity is reduced when encoding the original audio data in order to produce the bitstream 1. As more as the data quantity is reduced the likelihood of decoder overshoot clipping increases. Hence, decoder overshoot clipping prevention is enhanced when the limiter component 62 is controlled depending on the compression efficiency of the audio decoder device 9.

In an embodiment of this optional feature, a compression efficiency of the audio decoder device 9 is input to a clipping prediction device 54, which comprises a clipping prediction function 56 implemented in logic statements or gates, as a look-up table, or by other techniques of implementing a function of at least one variable as will be known to those skilled in the art. The output of the function 56 is fed through a minimum function 59, similarly implemented, which selects the lesser of its two inputs, to comparator 55. We consider here that the volume limit feature described below is not active and the switch 58 outputs a value corresponding to 0 dB FS (full scale) thus that the minimum function 59 is controlled by the output of the clipping prediction function 56. In this manner comparator 55 compares the output of the clipping protection function 56 to the maximum possible peak level of the processed audio signal 35 to determine if it is necessitated to engage the limiter 51 via limiter switch 52 to protect against clipping at the audio output signal 42.

In cases where the maximum level of the processed core decoder output signal 35 is less than the level predicted by clipping prediction function 56, there is no possibility of clipping due to decoder overshoots (within the confidence interval or error bound of the function 54) and the switch 52 selects the output of compensating buffer 53. Said buffer is merely a delay to match the processing delay of limiter 51, and will introduce only negligible computational workload, in comparison to the significant workload of the limiter 51.

According to an embodiment of the invention the control component 63 is configured to control the limiter component 62 depending on the gain value 33 of the gain control device 10, 15, 28. The maximum possible peak level of the audio output signal 42 is determined in this sub-case by the gain value 33 of the gain control device 10, 15, 28. If said value is 0 dB, the decoder device 41 is operating at its full-scale limits as commanded by the maximum setting of volume control value 20. As said volume control value 20 is reduced, the decoder device 41 will operate such that full-scale bitstream values reach only the maximum level set by the gain value 33 of the gain control device 10, 15, 28.

In this sub-case, where there is no metadata 3 present, the switch 60 outputs a 0 dB FS value as this is the maximum possible in the incoming audio data 2 of the bitstream 1.

According to an embodiment of the invention the control component 63 is configured to control the limiter component 62 depending on a true peak value 36 transmitted in the loudness metadata 3 of the bitstream 1 and indicating a maximum peak level of an audio source converted to the bitstream 1 by an external encoder. The use of this true peak value 36 allows the computation of a more accurate value for the maximum possible peak level of the audio output signal 42.

In the case, where bitstreams contain loudness metadata 3, the metadata 3 may be specified to also include the true peak measurement specified by ITU standard BS.1770-3. In this sub-case, the switch 60 selects the true peak value 36 contained in the loudness metadata 3 instead of the 0 dB FS constant. The sum of the gain adjustment 33 and the true peak value 36, indicating the maximum peak amplitude of the signal input 35 to the limiter 30, is computed by adder 61 and is then compared to the output of the clipping function 56 by comparator 55. The use of this true peak metadata value 36 merely allows the computation of a more accurate value for the maximum possible peak level of the audio output signal 41.

According to an embodiment of the invention the control component 63 is configured to control the limiter component 62 depending on a volume limit value 57 set by the user or manufacturer in order to prevent hearing damage. By these features hearing damages may be avoided efficiently.

In the case of limiting to avoid hearing damage, the device user or manufacturer may set a maximum peak level 57 to which the output must be limited using a volume limit signal. When the switch 58 is thrown to activate this volume limit feature, the minimum function 59 selects the lower of the two output levels needed to either engage the limiter 51 for limiting the output due to clipping prevention or for volume limiting. The output of the switch 58 is also input to the limiter 51 to set its threshold to the appropriate level.

According to an embodiment of the invention shown in FIG. 5 the control component 63 is configured to control the limiter component 62 depending on artistic limiter parameters 32 transmitted in the loudness metadata 3 of the bitstream 1 and indicating artistic limiter threshold values 74*a*, artistic limiter attack time values 74*b* and/or artistic limiter release time values 74*c*. These features allow the operation of the limiter device 30 to be under the creative control of the artist or content creator. The dynamic range control values 6, 7 contained in the loudness metadata 3 discussed previously allow the overall dynamic range of the content to be tailored to the listening environment through the use of compression gains that act with typical time constants of 100 ms to 3 seconds. In challenging listening environments, compression of the audio signal with these time constants may not produce a signal with sufficient loudness for intelligibility or enjoyment without unpleasantly high peak levels. There is also the possibility that music creators, who have traditionally produced only a highly compressed "crushed" mix, may desire to use the flexibility of this invention to produce both a "crushed" mix and an "uncrushed" mix with less limiting and compression, so that consumers may hear the "uncrushed" version in quiet environments or when desired.

To address both of these concerns, the limiter 30 can be reconfigured to operate in an Artistic Limiter mode as shown in FIG. 5.

In this mode, the loudness metadata 3 includes the artistic limiter parameters 32, shown in electrical bus notation in FIG. 5, which are sent for each audio frame of the content. Contained in 32 are limiter attack time, release time, and threshold values for the light and heavy modes selected by switch 12 and selected by a correspondingly ganged switch 73 to output bus 74. The bus 74 contains the selected artistic limiter threshold value 74*a*, which is added to the decoder gain adjustment 33 by adder 71, and the desired attack and release times 74*b* and 74*c*, which are supplied directly to limiter 51. Minimum function 72 is used to select either the Volume Limit 57 (or 0 dB FS if no volume limit is used) or the output of the adder 71. In this manner, normally the limiter 51 operates at a threshold controlled by the value 74*a* until the volume control 20 is increased to a point where the volume limit is reached and limits the maximum level of the limiter threshold. In this mode, the limiter 51 operates continuously, and the switch 52 is in the position shown. The artistic use of these parameters may be achieved by monitoring the output of a device, audio software plug-in, or other apparatus containing a copy of the invention during mixing, mastering, or other creative or distribution operations.

According to an embodiment of the invention there is no possibility to apply makeup-gain after the limiter device 30 to artificially increase its loudness, as this would remove the mild incentive mentioned above.

According to an embodiment of the invention the control component 63 is configured to control the limiter component 62 continually or repeatedly. These features allow variable control of the limiter component 62 over time.

According to an embodiment of the invention the limiter device 30 is configured to bypass the limiter 51 by way of a bypass device 53 having a transfer function which is, regarding a gain and a delay, similar to a transfer function of the limiter 51. By these features the work load of the signal processor 27 may be reduced significantly.

It will be understood by those skilled in the art that this process may be implemented in software as a series of computer instructions or in hardware components. The operations described here are typically carried out as software instructions by a computer CPU or Digital Signal Processor and the registers and operators shown in the figures may be implemented by corresponding computer instructions. However, this does not preclude embodiment in an equivalent hardware design using hardware components. Also, it will be understood by those skilled in the art that the values 4, 6, 7, 20, 33, 36, 57, 74*a*, and others will typically be expressed in a logarithmically-scaled domain as is standard practice and specified in the referenced standards. Further, the operation of the invention is shown here in a sequential, elementary manner. It will be understood by those skilled in the art that the operations may be combined, transformed, or precomputed in order to optimize the efficiency when implemented on a particular hardware or software platform. Also, it will be understood that these operations may be carried out on time-domain data or may be carried out in one or more frequency bands in the frequency domain.

In the construction of the improved decoder 41 device, those skilled in the art will recognize that it will be necessitated to use numerical representations, register lengths, or other ordinary means to avoid internal saturation, clipping, or overflow in the signal path from the audio decoder 9 through the multipliers 13 and 15, and the optional limiter device 30 to the audio output signal 42, as well as elsewhere in the invention.

It should be further understood that although the invention offers the specific merit of controlling clipping produced by decoder overshoots in lossy audio data-compression codecs such as AAC, MP3, or Dolby Digital, that it may also be used in audio systems with lossless audio codecs or with audio signals that are not compressed with an audio codec at all.

The invention may provide:

1. A system for audio loudness normalization which provides an output whose full-scale value is intended to correspond to the maximum peak output voltage or sound pressure level of an incorporating device, with said output's loudness level or average power controlled directly or indirectly by the user volume control of said device, such that both content with audio loudness metadata, and content without audio loudness metadata but normalized to its full-scale values, are reproduced at nearly the same audio loudness level.

2. A system where the long-term average power or perceived loudness of content without audio metadata is estimated by a fixed value determined by empirical or statistical analysis of content.

3. A system the estimate is biased to reproduce typical content without metadata at slightly lower loudness than the same content with properly prepared metadata, thus providing an incentive to use said metadata.

4. A system for data-compressed audio decoding containing an output peak limiter in which the need for peak limiting for the purpose of preventing clipping on decoder overshoots is determined by the target level of the compressed audio decoder and a computed function of the audio codec compression efficiency or bitrate.

5. A system for data-compressed audio decoding containing an output peak limiter in which the need for peak limiting for the purpose of preventing clipping on decoder overshoots is determined by the target level of the compressed audio decoder, a computed function of the audio codec compression efficiency or bitrate, and a metadata value indicating the maximum peak level of the audio program transmitted in the compressed bitstream.

6. A system for data-compressed audio decoding containing an output peak limiter in which the need for peak limiting for the purpose of limiting the maximum peak audio output of a device is determined by the target level of the compressed audio decoder.

7. A system for data-compressed audio decoding or audio processing containing an output peak limiter in which the need for peak limiting for the purpose of limiting the maximum peak audio output of a device is determined by the value of a scaling gain applied to the audio signal.

8. A system for data-compressed audio decoding or audio processing containing an output peak limiter in which the need for peak limiting for the purpose of limiting the maximum peak audio output of a device is determined by the value of a scaling gain applied to the audio signal and a metadata value indicating the maximum peak level of the audio program transmitted in the compressed bitstream.

9. A system where the limiter is replaced by a function with similar gain and delay when limiting is not required.

10. A system for data-compressed audio decoding or audio processing containing an output peak limiter, where the peak limiter threshold is controlled by a metadata value transmitted in the compressed bitstream on a periodic basis.

11. A corresponding method or non-transitory storage for audio loudness normalization which provides an output whose full-scale value is intended to correspond to the maximum peak output voltage or sound pressure level of an incorporating device, with said output's loudness level or average power controlled directly or indirectly by the user volume control of said device, such that both content with audio loudness metadata, and content without audio loudness metadata but normalized to its full-scale values, are reproduced at nearly the same audio loudness level.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] International Organization for Standardization and International Electrotechnical Commission, ISO/IEC 14496-3 Information technology—Coding of audio-visual objects—Part 3: Audio, www.iso.org.

[2] European Telecommunications Standards Institute, ETSI TS 101 154: Digital Video Broadcasting (DVB); Specification for the use of Video and Audio Coding in Broadcasting Applications based on the MPEG-2 transport stream, www.etsi.org.

[3] Advanced Television Systems Committee, Inc., Audio Compression Standard A/52, www.atsc.org.

[4] International Telecommunications Union, Recommendation ITU-R BS.1770-3: Algorithms to measure audio programme loudness and true-peak audio level, www.i-tu.int.

[5] Martin Wolters, Harald Mundt, and Jeffrey Riedmiller, "Loudness Normalization In The Age Of Portable Media Players", paper 8044, Audio Engineering Society 128th Convention, www.aes.org

[6] Florian Camerer, et al, "Loudness Normalization: The Future of File-Based Playback," Music Loudness Alliance, www.music-loudness.com.

[7] Dolby Laboratories, Inc., Dolby Digital Professional Encoding Guidelines, www.dolby.com.

[8] Perttu Hamalainen, "Smoothing Of The Control Signal Without Clipped Output In Digital Peak Limiters", Proc. of the 5th International Conference on Digital Audio Effects, Hamburg, Germany, Sep. 26-28, 2002.

The invention claimed is:

1. A decoder device for decoding a bitstream so as to produce therefrom an audio output signal, the bitstream comprising audio data and optionally loudness metadata comprising a reference loudness value, the decoder device comprising:

an audio decoder device configured to reconstruct an audio signal from the audio data; and a signal processor configured to produce the audio output signal based on the audio signal;

wherein the signal processor comprises a gain control device configured to adjust a loudness level of the audio output signal;

wherein the gain control device comprises a reference loudness decoder configured to create a loudness value, wherein the loudness value is the reference loudness value in case that the reference loudness value is present in the bitstream;

wherein the gain control device comprises a gain calculator configured to calculate a gain value based on the loudness value and based on a volume control value, which is provided by an user interface allowing a user to control the volume control value;

wherein the gain control device comprises a loudness processor configured to control the loudness level of the audio output signal based on the gain value.

2. The decoder device according to claim 1, wherein the loudness value is a preset loudness value in case that the reference loudness value is not present in the bitstream.

3. The decoder device according to claim 2, wherein the preset loudness value is set to a value between −4 dB and −10 dB, in particular between −6 dB and −8 dB, referenced to a full-scale amplitude.

4. The decoder device according to claim 1, wherein the signal processor comprises a dynamic range control device configured to adjust a dynamic range of the audio output signal, wherein the dynamic range control device comprises a dynamic range control switch configured to derive at least one dynamic range control value from the loudness metadata and to output alternatively one of the derived dynamic range control values or a preset dynamic range control value, wherein the dynamic range control device comprises a dynamic range calculator configured to calculate a dynamic range value based on the dynamic range control value outputted by the dynamic range control switch and based on a compression control value, which is provided by an user interface allowing a user to control the compression control value;

wherein the dynamic range control device comprises a dynamic range processor configured to control the dynamic range of the audio output signal based on the dynamic range value.

5. The decoder device according to claim 1, wherein the signal processor comprises a limiter device configured to limit an amplitude of the output audio signal, wherein the limiter device comprises a limiter component comprising a limiter and a control component configured to control the limiter component, wherein a processed audio signal, which is derived from the audio signal by being processed at least by the gain control device, is inputted to the limiter component, and wherein the audio output signal is outputted from the limiter component.

6. The decoder device according to claim 5, wherein the control component is configured to control the limiter component depending on a bitrate of the bitstream.

7. The decoder device according to claim 5, wherein the control component is configured to control the limiter component depending on a compression efficiency of the audio decoder device.

8. The decoder device according to claim 5, wherein the control component is configured to control the limiter component depending on a true peak value transmitted in the loudness metadata of the bitstream and indicating a maximum peak level of an audio source converted to the bitstream by an external encoder.

9. The decoder device according to claim 5, wherein the control component is configured to control the limiter component depending on the gain value of the gain control device.

10. The decoder device according to claim 5, wherein the control component is configured to control the limiter component depending on a volume limit value set by the user or manufacturer in order to prevent hearing damage.

11. The decoder device according to claim 5, wherein the control component is configured to control the limiter component depending on artistic limiter parameters transmitted in the loudness metadata of the bitstream and indicating artistic limiter threshold values, artistic limiter attack time values and/or artistic limiter release time values.

12. The decoder device according to claim 5, wherein the control component is configured to control the limiter component continually or repeatedly.

13. The decoder device according to claim 5, wherein the limiter device is configured to bypass the limiter by way of a bypass device comprising a transfer function which is, regarding a gain and a delay, similar to a transfer function of the limiter.

14. A system comprising a decoder device and an encoder, wherein the decoder device is designed according to claim 1.

15. A method of decoding a bitstream so as to produce therefrom an audio output signal, the bitstream comprising audio data and optionally loudness metadata comprising a reference loudness value, the method comprising:

reconstructing an audio signal from the audio data using an audio decoder device; and producing the audio output signal based on the audio signal using a signal processor;

wherein a loudness level of the audio output signal is adjusted using a gain control device comprised by the signal processor;

wherein a loudness value is created by a reference loudness decoder comprised by the gain control device, wherein the loudness value is the reference loudness value in case that the reference loudness value is present in the bitstream;

wherein a gain value is calculated based on the loudness value and based on a volume control value, which is provided by an user interface allowing a user to control the volume control value, by a gain calculator comprised by the gain control device;

wherein the loudness level of the audio output signal is controlled based on the gain value by a loudness processor comprised by the gain control device.

16. A non-transitory computer-readable storage medium having stored thereon a computer program to decode a bitstream so as to produce therefrom an audio output signal, the bitstream comprising audio data and optionally loudness metadata comprising a reference loudness value, the computer program running on a computer or a processor and performing the method of claim 15.

* * * * *